US006814594B1

(12) United States Patent
Huang

(10) Patent No.: US 6,814,594 B1
(45) Date of Patent: Nov. 9, 2004

(54) COMPOSITE ELASTIC MEMBER OF SOCKET SAFETY PROTECTIVE COVER

(76) Inventor: Cheng-Fu Huang, No. 15, Lane 21, Sianbei St., Tainan City 704 (TW)

( * ) Notice: Subject to any disclaimer, the term of this patent is extended or adjusted under 35 U.S.C. 154(b) by 0 days.

(21) Appl. No.: 10/661,924

(22) Filed: Sep. 15, 2003

(51) Int. Cl.[7] ..... H01R 13/44
(52) U.S. Cl. ..... 439/137; 439/145
(58) Field of Search ..... 439/137, 145

(56) References Cited

U.S. PATENT DOCUMENTS 4,722,693 A * 2/1988 Rose ..... 439/137
6,217,353 B1 * 4/2001 Yu-Tse ..... 439/145
6,238,224 B1 * 5/2001 Shao ..... 439/137
6,422,880 B1 * 7/2002 Chiu ..... 439/137
6,537,088 B2 * 3/2003 Huang ..... 439/137
6,537,089 B1 * 3/2003 Montague ..... 439/145

* cited by examiner

*Primary Examiner*—Gary Paumen

(57) ABSTRACT

The invention discloses a composite elastic member of socket protective safety cover, in that the composite elastic member is disposed in a socket safety protective cover, is capable of providing the protective cover with vertical restoring elasticity and horizontal elasticity, and forms fulcrums for swinging movements of the protective cover. The composite elastic member includes vertical elastic plates, a horizontal elastic plate and a fixing section. A highest point of each vertical elastic plate forms a support point. The horizontal elastic plate is located at a side of the vertical elastic plates, and has action directions perpendicular to those of the vertical elastic plates. The fixing section is located out of action ranges of the vertical elastic plates and the horizontal elastic plate, and is for fixing an entire structure to an external object.

2 Claims, 8 Drawing Sheets

A - A

COMPOSITE ELASTIC MEMBER OF SOCKET SAFETY PROTECTIVE COVER

BACKGROUND OF THE INVENTION (a) Field of the Invention

The invention relates to a composite elastic member of socket safety protective cover, and more particularly, to a composite elastic member disposed at a socket safety protective cover, being capable of simultaneously providing the safety protective cover with vertical and horizontal restoring elasticity, and forming fulcrums during swinging movements of the protective cover.

(b) Description of the Prior Art

A common wall socket or an extension wire socket is generally provided with at least one set of receptacles, wherein each set of receptacles has two or three receptacles. However, several drawbacks are found after studying the aforesaid prior socket. First of all, the "open" socket lacks protective measures, and accidental electric shocks are repeated occurrences among children caused by curiosity. Secondly, the prior socket is an open structure as described, with conductive straps at an interior thereof mostly being conductive materials such as copper. These conductive materials are often formed with aerugo resulted from humidity for being exposed in air over long periods of time, or accumulated with dust, and hence conductive efficiencies thereof may become affected. To overcome the aforesaid shortcomings, a structure disclosed by the U.S. Pat. No. 6,537,088 is provided. Referring to FIG. 7, the structure comprises a socket housing D having a protective cover D1 capable of elastic horizontal movements; and two stopping members D2 each having an inclined plane and located at a top portion of the protective cover D1, with the two stopping members D2 blocking below receptacles D3. When pins B1 of a plug B are inserted into the receptacles D3, the inclined planes of the two stopping members D2 are simultaneously displaced to further horizontally move the entire protective cover D1, so as to conduct the plug B with conductive straps D4 by completely inserting the plug B into the receptacles D3. When an alien object C is inserted into one of the receptacles D3 as shown in FIG. 8, the alien object C imposes a downward force at one end of the protective cover D1. Leverage is formed from force received at one end of the protective cover D1, and the stopping member D2 at the other end of the protective cover D1 is lifted to block in the receptacle D3. As result, the protective cover D1 fails to displace horizontally with the protective cover D1 remaining blocked in the receptacles 3, thereby preventing potential hazards by forbidding the alien object C from coming into contact and conducting with the conductive straps D4.

However, according to the aforesaid U.S. Pat. No. 6,537,088, for that the protective cover D1 is incapable of vertical movements in a downward direction, the two stopping members D2 at the protective cover D1 cannot be extended into the receptacles D3 under normal circumstances. The reason behind is that, if the stopping members D2 are extended into the receptacles D3, the protective cover D1 would fail to displace horizontally under any circumstances. Yet, suppose the stopping members D2 are located below the receptacles D3 instead of being extended into the receptacles D3 under normal circumstances, it is rather unapparent that the stopping members D2 are capable of preventing horizontal displacements of the protective cover D1 when one observes an appearance of the structure from exterior. Hence, when such products are displayed and sold, a targeted appeal as protective functions provided by the protective cover D1 is hardly made distinguishing.

To resolve the aforesaid drawbacks, it is crucial that the protective cover D1 be capable of downward displacements, horizontal sliding movements and leverage swinging movements in order to allow the protective cover D1 with the following effects:

1. Under normal circumstances, the protective cover D1 has the stopping members D2 extended into the receptacles D3.
2. When the pins B1 of the plug B are inserted into the receptacles D3, the protective cover D1 first displaces downward and followed by horizontal movements to further open up.
3. When the alien object C is inserted into any of the receptacles D3, the protective cover D1 has the other stopping member D2 not being pushed remain in the receptacle D3 using leverage swinging movements, thereby preventing horizontal sliding movements of the protective cover.

SUMMARY OF THE INVENTION

The object of the invention is to provide a composite elastic member of socket safety protective cover fulfilling the aforesaid requirements. The composite elastic member is provided with both vertical and horizontal restoring elasticity, and has leverage fulcrums, so as to simplify a structure and speed up assembly processes thereof.

The invention comprises vertical elastic plates, a horizontal elastic plate and a fixing section. A highest point of each vertical elastic plate forms a support point. The horizontal elastic plate is located at a side of the vertical plates, and has action directions perpendicular to those of the vertical elastic plates. The fixing section is located out of action ranges of the vertical elastic plates and the horizontal elastic plate, and is for fixing the entire structure to an external object.

DETAILED DESCRIPTION OF THE PREFERRED EMBODIMENTS

To better understand the invention, detailed descriptions shall be given with the accompanying drawings hereunder.

Figure 1:
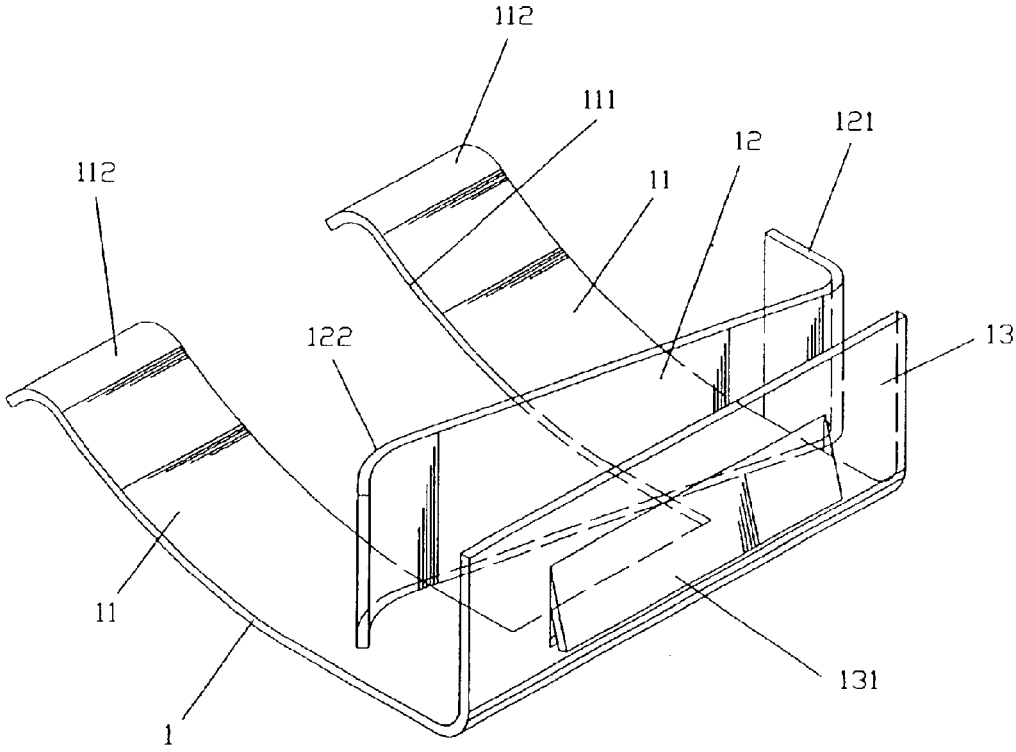
FIG. 1 shows a structural schematic view according to the invention.

Referring to FIG. 1 showing a preferred embodiment according to the invention, a composite elastic member 1 comprises vertical elastic plates 11, a horizontal elastic plate 12 and a fixing section 13. The vertical spring elastic plates 11 are located at a lower portion of the elastic member 1, and appear slightly arched in an upward direction while also having vertical elasticity. In the embodiment shown in FIG. 1, two vertical elastic plates 11 are provided, with a recess formed between the vertical elastic plates 11. Each vertical elastic plate 11 is further folded for forming a support point 112. The horizontal elastic plate 12 is a formed integral with the elastic member 1, and is located at a side of the vertical elastic plates 11. The horizontal elastic member 12 has one end thereof vertically folded for forming a fixed end 121, and a plate body thereof suspended and extended from the fixed end 121. A lower edge of the extended plate body has a gap in between with the vertical elastic plate 11, so as to allow the plate body to swing left-and-right. The plate body is also arched and folded to form a leaning point 122. Action directions of elasticity of the horizontal elastic plate 12 are perpendicular to those of the aforesaid vertical elastic plates 11. The fixing section 13 is out of action ranges of the vertical elastic plates 11 and the horizontal elastic plate 12. In the embodiment shown in FIG. 1, the fixing section 13 is a vertically folded plate body, and has an embedding portion 131 downwardly extended from the plate body in a slanting manner, so as to fix the entire structure to an external object.

Figure 2:
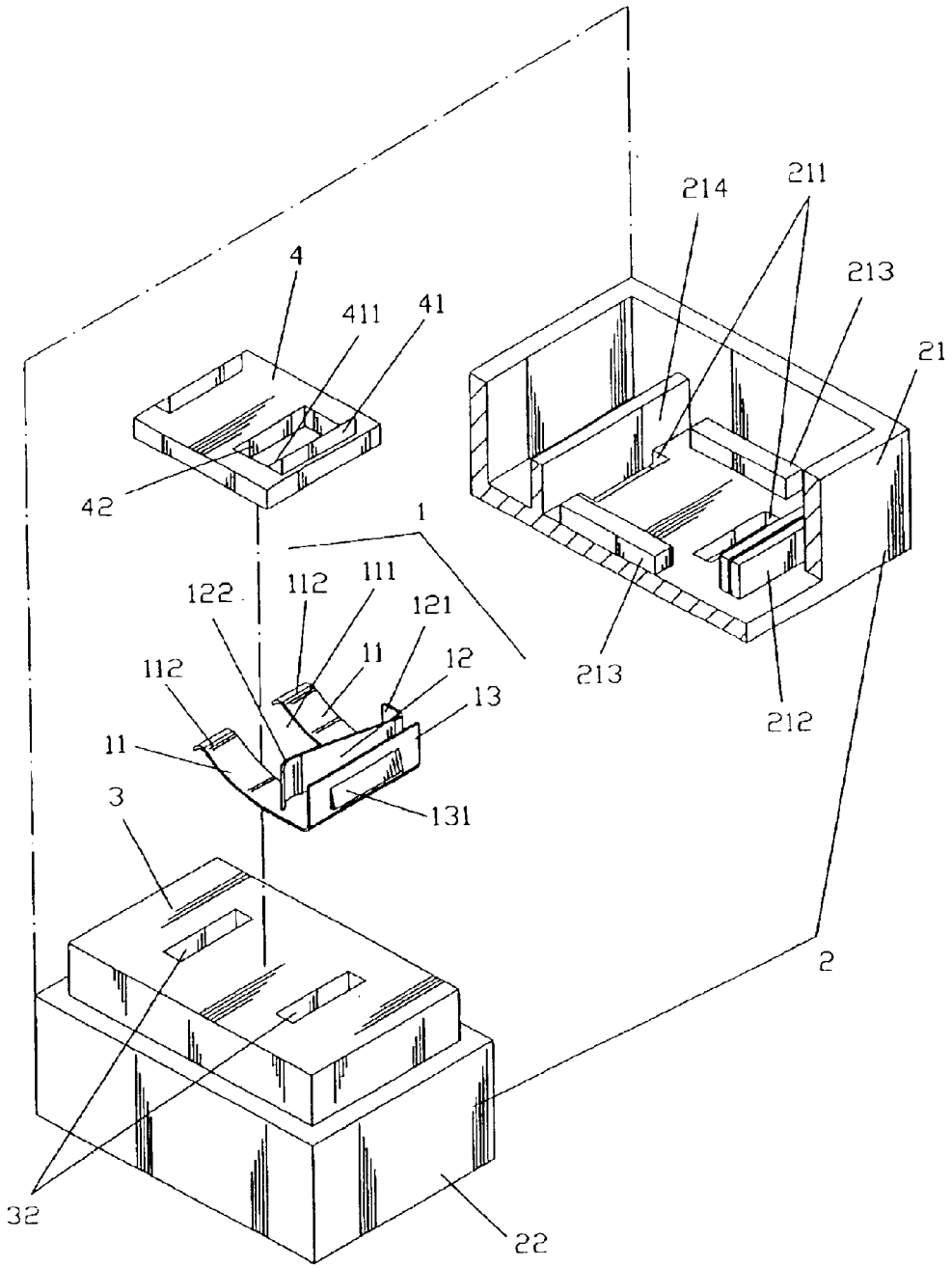
FIG. 2 shows an exploded elevational view of an embodiment according to the invention.

Referring to FIG. 2 showing an embodiment, a structure is assembled from an outer housing 2, an inner housing 3 and a sliding cover 4. The outer housing 2 is consisted of joined upper and lower housings 21 and 22. The upper housing 21 has receptacles 311 at an upper edge thereof, and is formed with a positioning member 212, retaining members 213 and a stopping member 214.

Figure 4:
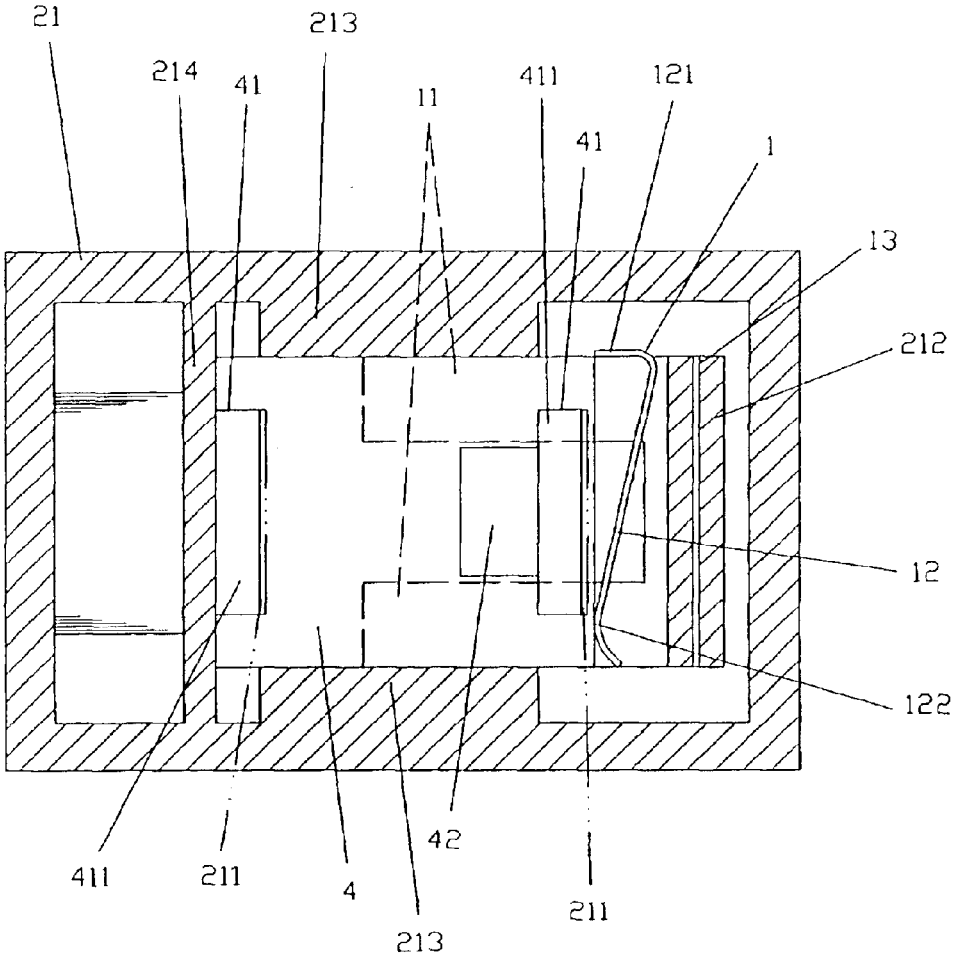
FIG. 4 shows a lateral sectional view of an embodiment according to the invention taken along A—A.

The inner housing 3 has conducting straps 31 at an interior thereof as shown in FIG. 4. For corresponding with the receptacles 211 at the upper housing 21, the inner housing 3 is similarly provided with inner receptacles 32 at an upper surface thereof.

The sliding cover 4 has wedge members 41 for corresponding with the receptacles 211 at the upper housing 21, wherein each wedge member 41 is provided with a passive inclined plane 411. Between the two sedge members 41 of the sliding cover 4 is an opening 42.

Figure 3:
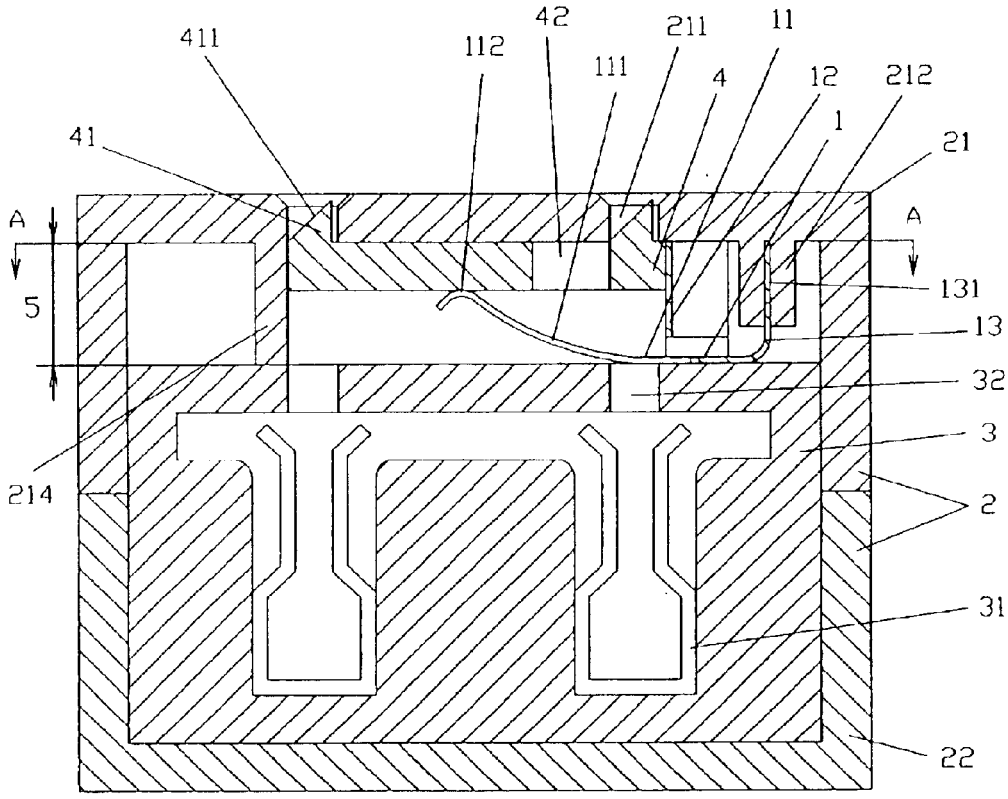
FIG. 3 shows a longitudinal sectional view of an embodiment according to the invention.

Referring to FIGS. 3 and 4, for assembly, the sliding cover 4 is placed at a gap 5 between the outer housing 2 and the inner housing 3. The fixing section 13 of the elastic member 1 is mounted and fastened to the positioning member 212 of the outer housing 2, and the embedding portion 131 of the elastic member 1 is firmly embedded into the positioning member 212, thereby locating the elastic member 1. The support points 112 of the vertical elastic plates 11 are pushed against a lower center portion of the sliding cover 4. The horizontal elastic plate 12 of the elastic member 1 is located at one end of the sliding cover 4, and is leaned against the sliding cover 4 via the leaning point 122 thereof. The vertical elastic plates 11 and the horizontal elastic plate 12 are butted against the sliding cover 4, such that the wedge members 31 at the sliding cover 4 are blocked in the receptacles 211 of the outer housing 21 under normal circumstances, thereby shielding the receptacles 211. Meanwhile, when the sliding cover 4 moves toward the vertical elastic plates 11 and the horizontal elastic plate 12, the vertical elastic plates 11 and the horizontal elastic plate 12 are deformed to provide the sliding cover 4 with vertical restoring elasticity and horizontal restoring elasticity. In addition, being located at the lower center portion of the sliding cover 4, the support points 112 of the vertical elastic plates 11 serve as fulcrums for swinging movements of the sliding base 4. After completing assembly of the structure, the sliding cover 4 is located between the retaining members 213 of the upper housing 21, and linear displacements thereof are maintained using guidance of the retaining members 213. Also, the stopping member 214 of the upper housing 21 serves for limiting purposes during restoring displacements of the sliding cover 4.

Figure 5:
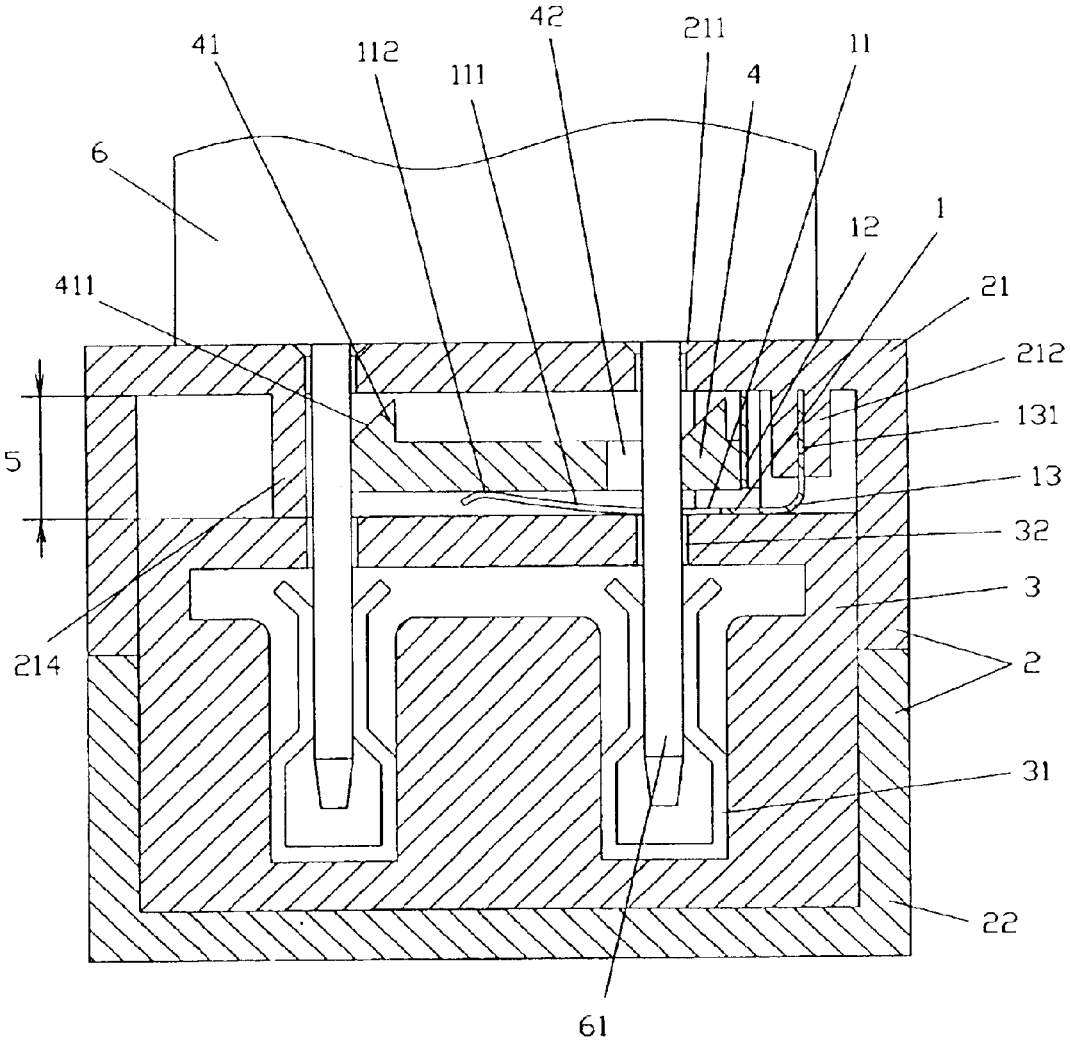
FIG. 5 shows a schematic view illustrating normal insertion movements in an embodiment according to the invention.

Referring to FIG. 5 showing a normal insertion, pins 61 of a plug 6 are simultaneously inserted into the receptacles 211 of the upper housing 21. Downward forces of the pins 61 are evenly distributed on the wedge members 41 of the sliding cover 4, so that the sliding cover 4 is levelly displaced in a downward direction and compressed. When the wedge members 41 of the sliding member 4 are departed from the receptacles 211, forces imposed on the wedge members 41 by the pins 61 produce a divided sideward force owing to the presence of the inclined planes 411, and the sliding cover 4 is horizontally displaced to laterally compress the horizontal elastic plate 12 of the elastic member 1. As a result, the sliding cover 4 is smoothly deviated for allowing continuous downward displacements of the pins 61 of the plug 6, thereby coming into contact with the conducting straps 31 after passing through the inner receptacles 32 of the inner housing 3.

Figure 6:
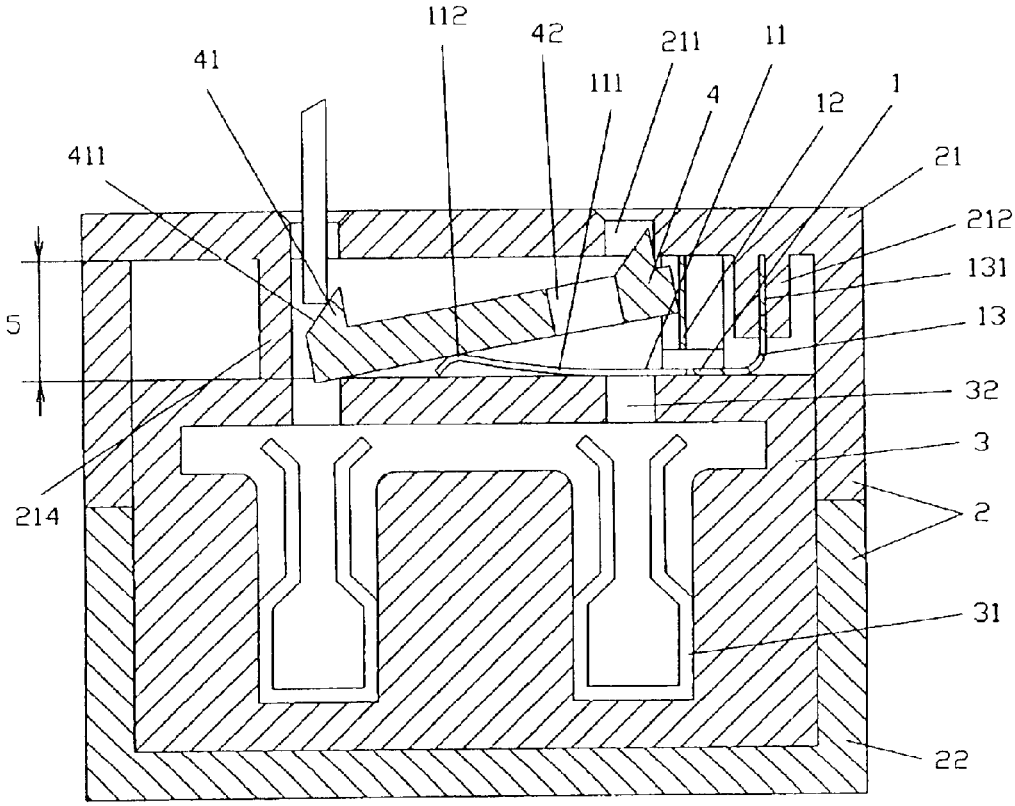
FIG. 6 shows a schematic view illustrating insertion movements of an alien object in an embodiment according to the invention.
Figure 7:
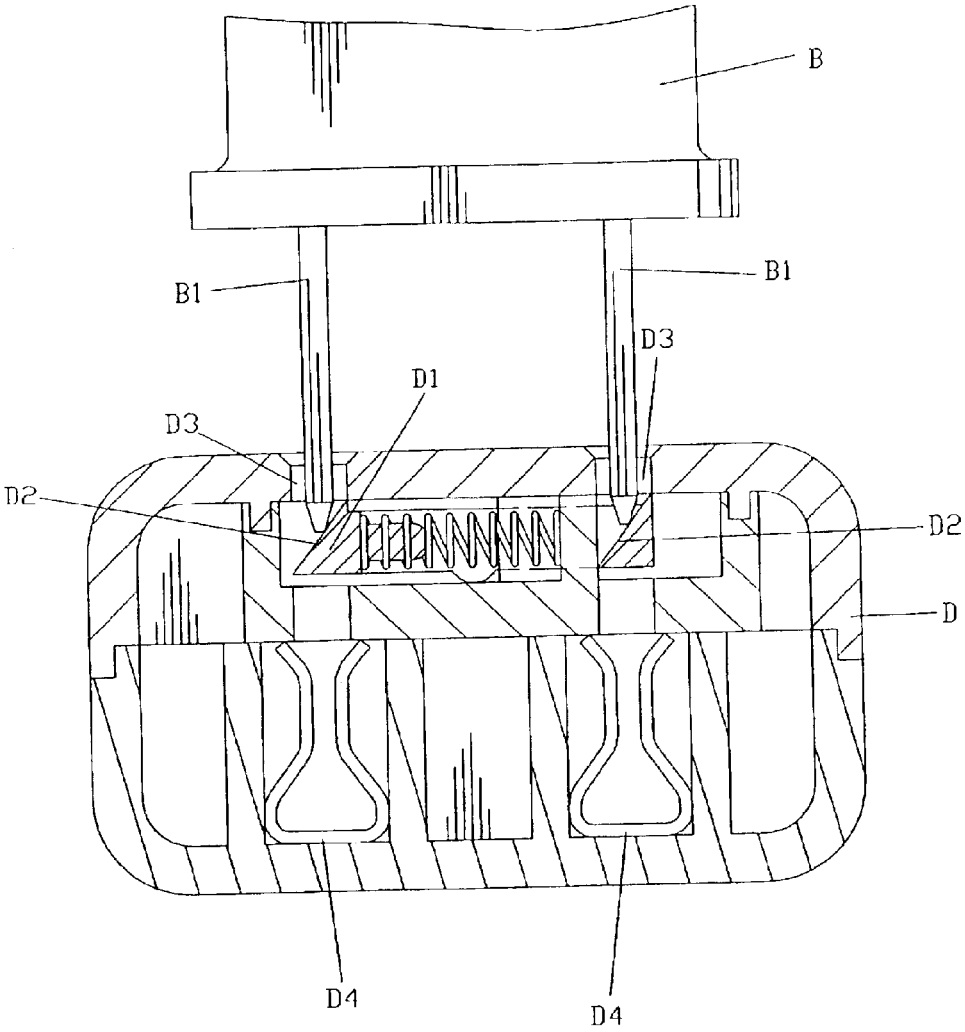
F I G. 7 PRIOR ART
FIG. 7 shows a schematic view illustrating normal insertion movements in an embodiment according to a prior art.
Figure 8:
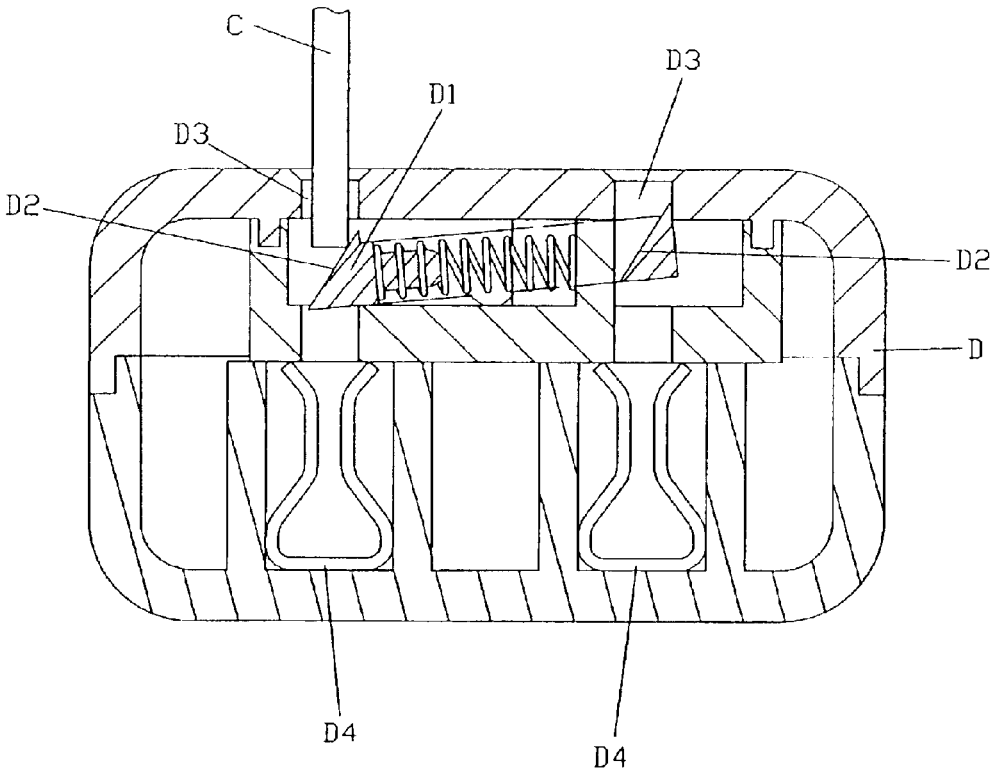
F I G. 8 PRIOR ART
FIG. 8 shows a schematic view illustrating insertion movements by an alien object in an embodiment according to a prior art.

Referring to FIG. 6, when an alien object is independently inserted into any of the receptacles 211 of the upper housing 21, the sliding cover 4 is deviated regarding the support points 112 of the vertical elastic plates 11 as fulcrums thereof due to unevenly distributed forces received. At this point, the other unmoved the wedge member 41 of the sliding cover 211 remains wedged in the receptacle 211 of the upper housing 21, and thus horizontal movements of the sliding cover 4 are prohibited. Consequently, the alien object is prevented from downward displacements, and is forbidden to pass through the inner receptacle 32 of the inner housing 32 to come into contact with the conducting strap 31.

It is apparent from the embodiment according to the invention that, the vertical elastic plates 11 provide the sliding cover 4 with vertical restoring elasticity, with the support points 112 of the vertical elastic plates 11 forming fulcrums during deviations of the sliding cover 4. Furthermore, the horizontal elastic plate 12 provides the sliding cover 4 with horizontal restoring elasticity. Using the structure according to the invention, the sliding cover 4 smoothly accomplishes downward displacements, upward repositioning, horizontal movements, horizontal repositioning and leveraged deviations, thereby providing the sliding cover 4 with protective effects. More especially, the vertical elastic plates 11, the horizontal elastic plate 12 and the fixing section 13 are a formed integral, and hence not only manufacturing is facilitated, but also assembly is also made speedy.

The aforesaid vertical elastic plates 11, the horizontal elastic plate 12 and the fixing section 13 may also be individually formed and formed into an integral by processing such as welding, riveting and inlaying.

It is of course to be understood that the embodiments described herein are merely illustrative of the principles of the invention. For example, a wide variety of modifications of the vertical elastic plates 11, the horizontal elastic plate 12 and the fixing section 13 may be effected by persons skilled in the art without departing from the spirit and scope of the invention as set forth in the following claims.

What is claimed is:

1. A socket safety protective cover having a composite elastic member comprising:

vertical moveable plastic plates, a horizontal movable elastic plate and a fixing section; wherein, a highest point of each vertical elastic plate forms a support point supporting the cover, horizontal elastic plate is located at a side of the vertical elastic plates and biases the cover horizontally, and the fixing section is located out of action ranges of the vertical and horizontal elastic plates.

2. The socket safety protective cover having a composite elastic member in accordance with claim 1, wherein the fixing section is a vertically folded plate body, which is provided with a lance extending from the plate body in a downwardly slanting manner.

* * * * *